United States Patent [19]

Mita et al.

[11] Patent Number: 4,705,097

[45] Date of Patent: Nov. 10, 1987

[54] RADIATOR DEVICE

[75] Inventors: Hideo Mita, Okazaki; Shuichi Kurazono, Toyota, both of Japan

[73] Assignee: Aisin Seiki Kabushiki Kaisha, Kariya, Japan

[21] Appl. No.: 843,587

[22] Filed: Mar. 25, 1986

[30] Foreign Application Priority Data

Mar. 30, 1985 [JP] Japan ..... 60-67662
Mar. 30, 1985 [JP] Japan ..... 60-67663

[51] Int. Cl.[4] ..... F28D 17/02
[52] U.S. Cl. ..... 165/4; 165/10
[58] Field of Search ..... 165/4, 10

[56] References Cited

U.S. PATENT DOCUMENTS 1,776,165 9/1930 Martinba ..... 165/10
2,706,109 4/1955 Odman ..... 165/10
3,965,695 6/1976 Rush et al. ..... 165/10

FOREIGN PATENT DOCUMENTS 1077508 5/1954 France ..... 165/10

*Primary Examiner*—Albert W. Davis, Jr.
*Attorney, Agent, or Firm*—Burns, Doane, Swecker & Mathis

[57] ABSTRACT

A radiator device includes a plurality of filler plates made from a low heat conductivity and high specific heat such as for example gadolinium/rhodium and a plurality of spacer members disposed on each one side of the filler plates to form a fluid flow passage and a housing member accomodating the spacer and the filler plates.

1 Claim, 8 Drawing Figures

RADIATOR DEVICE

BACKGROUND OF THE INVENTION

1. Field of the Invention

This invention relates to a radiator and more particularly to a multi-plate type radiator particularly used in a Stirling cycle or Gifford cycle refrigerators.

2. Prior Art Statement

In a radiator for refrigerators, it is important to have a heat conducting area as large as possible and to increase the rate of space occupying. Conventionally, for example, a Japanese Pat. Publication No. 43(1968)-10939 discloses a type of radiator illustrated in FIGS. 1 and 2. Therein, a belt shaped paper sheet 1 has a pair of lead layers 2 attached to both sides of the paper sheet 1. An upper side of the lead layer 2 has a plurality of bell shaped projections 3 for defining fluid flow passages when it is wrapped up as seen in FIG. 2.

In this conventional type, however, the material used should be restricted to a soft and relatively high specific heat due to the necessity of roller finish on the front layer so as to have a constant thickness. Thus, many conventional devices have used lead materials as a radiator plate members. Since the lead can be used in a refrigerator of 1Ok degree at most and it is impossible to apply to a refrigerator which needs a lower cooling capacity.

It is, therefore, an object of the present inventin to provide a radiator for a refrigerator having lower cooling capacities.

It is another object of the invention to provide a radiator device for a refrigerator using non-lead material for a radiator filler members.

BRIEF DESCRIPTION OF THE DRAWINGS

These and other objects of the invention will be apparent from the following detail description of the invention with reference to the attached drawings in which.

DETAILED DESCRIPTION OF THE EMBODIMENTS

Figure 1:
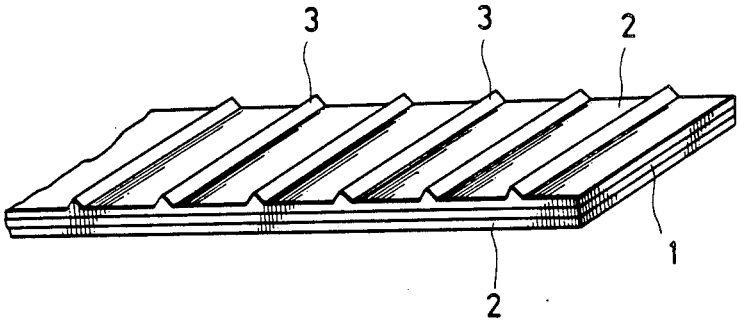
FIG. 1 is a perspective view of a filler of the radiator according to a conventional device.
Figure 2:
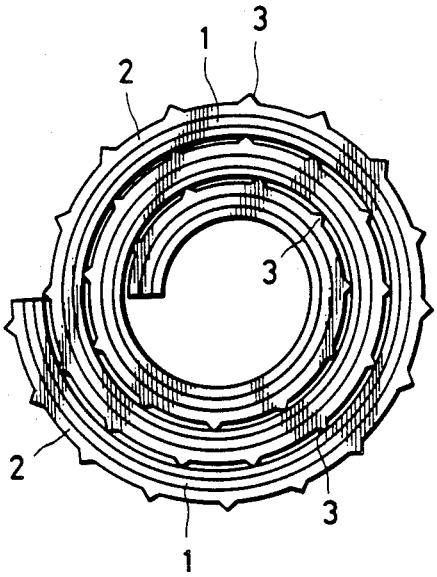
FIG. 2 is a front view of the filler of FIG. 1 but showing in wrapped condition.
Figure 3:
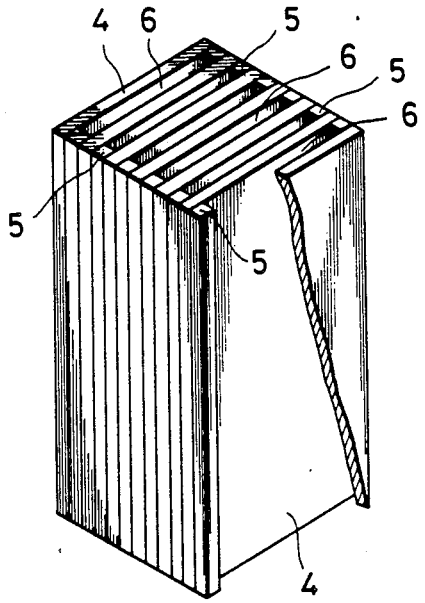
FIG. 3 is a perspective view of the filler assembly according to a first embodiment of the present invention.

In FIG. 3, fillers 4 are made from a material having a high specific heat and relatively low heat conductivity such as gadolinium/rhodium or gadolinium/erbium/-rhodium.

Figure 4:
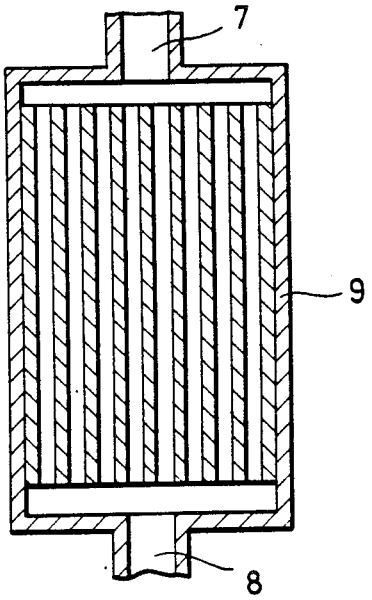
FIG. 4 is a cross sectional view of the filler assembly of FIG. 3.
Figure 5:
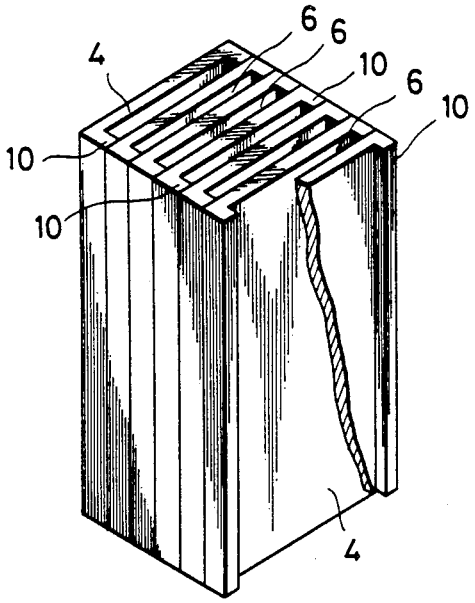
FIG. 5 is a similar view to FIG. 3 but showing a different embodiment of the invention.
Figure 6:
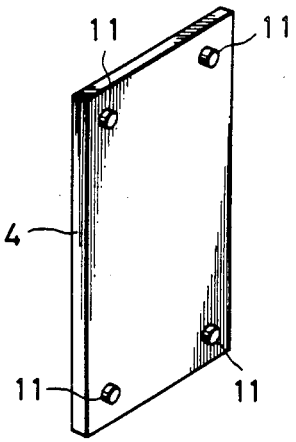
FIG. 6 shows a single filler plate of a further embodiment of the invention.

A plurality of spacers 5 are provided at two edge portions of each side of the filler 4 so as to define fluid passages 6 therebetween thereby to form a filler assembly. This assembly is housed in a housing 9 (in FIG. 4) having an inlet 7 and an outlet 8 to form a radiator device. The cross sectional area of the passage 6 can be changed by changing the thickness of the spacers 5. Instead of using spacers 5, each filler 4 may be provided with a pair of flanges 10 integrally formed with the filler as viewed in FIG. 5. Another embodiment is illustrated in FIG. 6 wherein the spacer or flange may be in the shape of projections 11, as shown.

Figure 7:
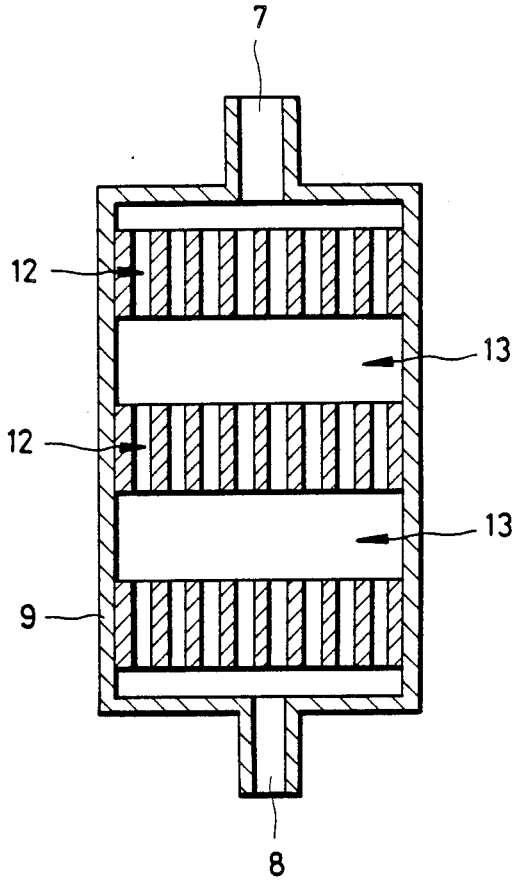
FIG. 7 is similar to FIG. 4 but showing a different embodiment of the invention.
Figure 8:
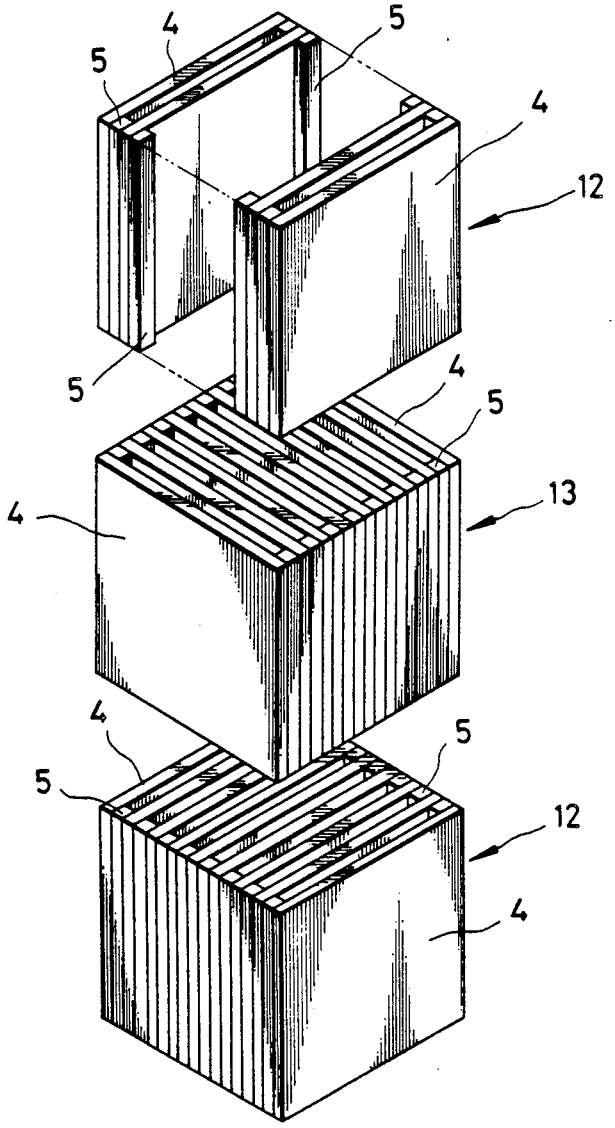
FIG. 8 in an exploded view of the assembly illustrated in FIG. 7.

In FIGS. 7 and 8, the filler assemblies 12, 13 of FIG. 3 are disposed in the radiator housing at a right angle to each other and stacked up so that the heat conductivity may be reduced in the fluid flow direction.

What is claimed is:

1. A radiator device comprising:

a plurality of filler plates, each of said plates being made from a material having a low heat conductivity and high specific heat;

a plurality of spacer means positioned on each side of said filler plates in the form of projections projecting from said each side to form a fluid passage therebetween;

a housing having an inlet and an outlet substantially centrally positioned with respect to the housing for a fluid and enclosing a filler assembly formed by said filler plates and spacer means; and at least three of said filler assemblies positioned in said housing so that each said assembly is positioned at an angle to an adjacent filler assembly so as to reduce heat conductivity in a fluid flow direction.

* * * * *